US005643109A

United States Patent [19]

Rose et al.

[11] Patent Number: 5,643,109

[45] Date of Patent: Jul. 1, 1997

[54] TENSIONED BAND GOLF PUTTER HEAD

[76] Inventors: Arthur S. Rose, P.O. Box 69604, Seattle, Wash. 98168; Guy T. Andrews, P.O. Box 3130, Kent, Wash. 98032

[21] Appl. No.: 662,441

[22] Filed: Jun. 10, 1996

[51] Int. Cl.[6] ..... A63B 53/04

[52] U.S. Cl. ..... 473/329; 473/340

[58] Field of Search ..... 473/329, 333, 473/342, 340, 219, 223, 226, 235, 236, 238, 242, 251

[56] References Cited

U.S. PATENT DOCUMENTS

| | | | |
|---|---|---|---|
| 777,400 | 12/1904 | Clark | 473/329 |
| 2,111,249 | 3/1938 | Plese . | |
| 4,113,249 | 9/1978 | Beery | 473/329 |
| 5,316,304 | 5/1994 | Yost | 473/330 |
| 5,464,212 | 11/1995 | Cook | 473/340 |

FOREIGN PATENT DOCUMENTS

| | | | |
|---|---|---|---|
| 646942 | 8/1962 | Canada | 273/80.1 |
| 18616 | of 1909 | United Kingdom | 273/78 |
| 2717 | of 1909 | United Kingdom | 273/78 |
| 547946 | 9/1942 | United Kingdom | 273/78 |

*Primary Examiner*—Sebastiano Passaniti

[57] ABSTRACT

A Tensioned Band Golf Putter Head comprising a continuous band of a strong flexible nature wrapped about a tensioning device which is of metallic construction and consists of a substantially rectangular block having a top, bottom, front, and rear surfaces and two rounded ends and a threaded aperture equidistant from the two rounded ends and perpendicular to the front surface adapted to mount a tensioning jack screw. The jack screw has a threaded end adapted to screw into the threaded aperture of the rectangular block and an other end adapted to mount a tensioning shoe for transferring the movement of the jack screw to the aforementioned band on the rear side of the rectangular block. The tensioning shoe is a metal block of substantially rectangular shape with it's rear surface rounded and it's front surface containing an aperture adapted to accept the jack screw at the mid-point of said tensioning shoe. An aperture is included in the top surface of the rectangular block adapted to mount a shaft of industry standard construction. The front surface of the rectangular block is mortised so as to allow for contact with the continuous band only at the ends of said mortise and to allow for flexing of said continuous band throughout the length of said mortis. In operation the continuous band is used as the striking surface for a soft feel of the ball during the putting stroke. The tensioning device is adapted to allow for a range of tension adjustments to tune the feel of the club to the individual users preference.

1 Claim, 1 Drawing Sheet

TENSIONED BAND GOLF PUTTER HEAD

BACKGROUND

1. Field of Invention

This invention relates to improvements golf clubs and in particular to putters.

2. Description of Prior Art

The basic design of the putter has not changed much in the past 100 years. There have been changes in the materials used, and in the methods of balancing, but for the most part, the putter has historically been a metal club for striking the ball to set it rolling on the green. Golfers have always searched for ways to obtain a better "feel" for the ball, which has prompted the use of different materials as inserts into the striking face, and the use of different compositions in the ball itself. The use of softer compositions in the ball, such as in the "ballata" ball has usually been detrimental to the distance or durability of the ball.

It is an object of the present invention to provide an improved feel for the ball and therefore better accuracy for the final approach of the ball to the hole.

SUMMARY OF THE INVENTION

The above and other beneficial objects and advantages are accomplished in accordance with the present invention by an improved apparatus which comprises a continuous band of a strong flexible nature wrapped about a tensioning device which is of metallic construction and consists of a substantially rectangular block having a top, bottom, front, and rear surfaces and two rounded ends and a threaded aperture equidistant from the two rounded ends and perpendicular to the front surface adapted to mount a tensioning jack screw. The jack screw has a threaded end adapted to screw into the threaded aperture of the rectangular block and an other end adapted to mount a tensioning shoe for transferring the movement of the jack screw to the aforementioned band on the rear side of the rectangular block. The tensioning shoe is a metal block of substantially rectangular shape with it's rear surface rounded and it's front surface containing an aperture adapted to accept the jack screw at the midpoint of said tensioning shoe. An aperture is included in the top surface of the rectangular block adapted to mount a shaft of industry standard construction. The front surface of the rectangular block is mortised so as to allow for contact with the continuous band only at the ends of said mortise and to allow for flexing of said continuous band throughout the length of said mortis. In operation the continuous band is used as the striking surface for a soft feel of the ball during the putting stroke. The tensioning device is adapted to allow for a range of tension adjustment to tune the feel of the club to the individual user.

DESCRIPTION OF THE PREFERRED EMBODIMENT

Figure 4:
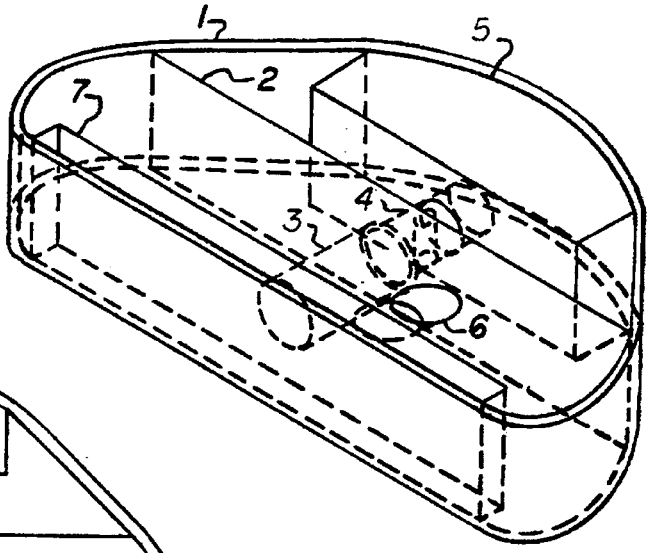
FIG. 4 is an isometric projection of the embodiment of FIG. 1.
Figure 1:
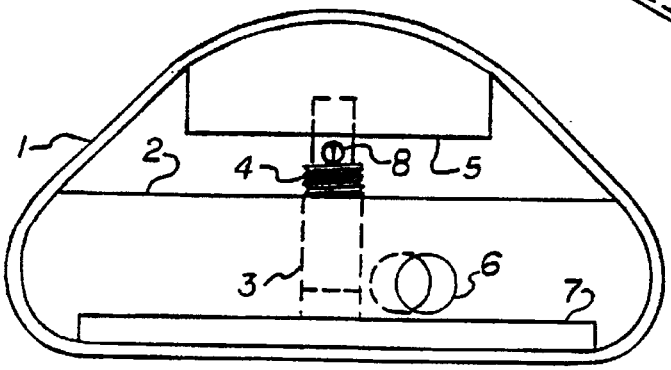
FIG. 1 is a top view of the preferred embodiment of this invention.
Figure 2:
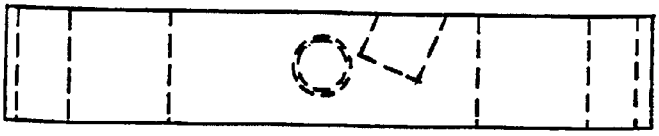
FIG. 2 is a front view of the embodiment of FIG. 1.
Figure 3:
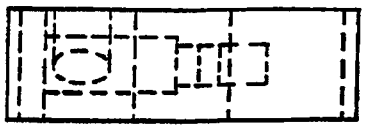
FIG. 3 is a side view of the embodiment of FIG. 1.

Referring to the drawings, an embodiment of the apparatus of this invention is shown comprising a continuous band (1) of a strong flexible nature wrapped about a tensioning device of metallic construction consisting of a substantially rectangular block (2) having a top, bottom, front, and rear surfaces and two rounded ends and a threaded aperture (3) equidistant from the two rounded ends and perpendicular to the front surface adapted to mount a tensioning jack screw (4). The jack screw (4) has a threaded end adapted to screw into the threaded aperture of the rectangular block (2) and an other end adapted to mount a tensioning shoe (5) for transferring the movement of the jack screw (4) to the aforementioned band (1) on the rear side of the rectangular block (2). The tensioning shoe (5) is a metal block of substantially rectangular with its rear surface rounded and its front surface containing an aperture adapted to accept the jack screw (4) at the mid-point of said tensioning shoe (5). An aperture (6) is included in the top surface of the rectangular block (2) adapted to mount a shaft of industry construction. The front surface of the rectangular block (2) is mortised (7) so as to allow for contact with the continuous band (1) only at the ends of the mortise (7) and to allow for flexing of the continuous band (1) throughout the length of the mortise (7). The tensioning jack screw (4) contains an aperture (8) adapted to allow for application of rotary force by external adjustment tool means.

In operation a continuous band (1) is used to strike a golf ball so as to roll the ball on a putting green. The continuous band is supported and tensioned by the cooperation of the rectangular block (2), jack screw (4), and tensioning shoe (5) on the inside surface of the continuous band (1). An aperture (6) is adapted to mount a shaft of industry standard design.

The foregoing description is included to illustrate the operation of the preferred embodiment and is not meant to limit the scope of the invention. From the foregoing description, variations will be apparent to those skilled in the art which would yet be encompassed by the spirit and scope of the invention, therefore the scope of the invention is to be limited only by the following claims.

What is claimed is:

1. A golf putter head comprising:

(a) a continuous band of flexible material;

(b) a rectangular block having top, bottom, front and rear surfaces and two spaced apart rounded ends, said block having a threaded aperture located equidistant between said two rounded ends and perpendicular to a plane containing the front surface, said block having a smooth aperture on said top surface adapted to accept a golf club shaft;

(c) a tensioning jack screw having a threaded end adapted to screw into the threaded aperture of said rectangular block and an other end opposite to said threaded end adapted to mount a tensioning shoe; and (d) a tensioning shoe of metallic construction being substantially rectangular with a rounded rear surface and a front surface containing an aperture adapted to accept said jack screw at a longitudinal mid-point of the front surface of said tensioning shoe;

(e) whereby, said continuous band is supported and tensioned by the cooperation of said rectangular block, said jack screw and said tensioning screw.

* * * * *